United States Patent [19]

Choi

[11] 4,101,412

[45] Jul. 18, 1978

[54] PROCESS AND APPARATUS FOR RAPID PYROLYSIS OF CARBONACEOUS MATERIALS

[75] Inventor: Charles K. Choi, Claremont, Calif.

[73] Assignee: Occidental Petroleum Corporation, Los Angeles, Calif.

[21] Appl. No.: 700,049

[22] Filed: Jun. 25, 1976

[51] Int. Cl.[2] ..... B01D 45/12; C10B 49/16; C10B 55/08; C10G 1/00

[52] U.S. Cl. ..... 208/8; 48/111; 48/209; 48/210; 55/419; 55/459 B; 201/2.5; 201/12; 201/22; 201/25; 201/28; 201/33; 202/99; 208/11 R

[58] Field of Search ..... 201/2.5, 8, 10, 12, 201/22, 23, 25, 28, 38, 42, 33; 55/419, 459 R, 459 B; 209/144; 208/8, 11 R; 202/84, 85, 99, 108; 48/210, 209, 111, 77, 101

[56] References Cited

U.S. PATENT DOCUMENTS

| | | | |
|---|---|---|---|
| 1,954,352 | 4/1934 | Dornbrook et al. | 55/459 R X |
| 2,582,712 | 1/1952 | Howard | 201/28 X |
| 2,655,443 | 10/1953 | Moore | 48/206 |
| 2,707,444 | 5/1955 | Van Loon | 110/28 F |
| 2,723,951 | 11/1955 | Minet | 201/28 X |
| 2,739,104 | 3/1956 | Galbreath et al. | 201/33 X |
| 2,767,840 | 10/1956 | Dobson et al. | 55/459 R X |
| 2,920,945 | 1/1960 | Totzek | 48/206 |
| 3,541,003 | 11/1970 | Carr et al. | 423/659 X |
| 3,565,766 | 2/1971 | Eddinger et al. | 201/28 X |
| 3,992,266 | 11/1976 | Aktoy et al. | 201/8 |

*Primary Examiner*—Joseph Scovronek
*Attorney, Agent, or Firm*—Christie, Parker & Hale

[57] ABSTRACT

Carbonaceous materials are rapidly pyrolyzed by feed of the carbonaceous material at a high velocity tangentially to a cyclone reactor-separator while introducing a high velocity stream of a particulate source of heat into the cyclone reactor-separator at an angle inclined to the path of travel of the carbonaceous material. The cyclone reactor-separator induces separation of solids consisting of the particulate carbon containing solid residue of pyrolysis and particulate heat source from a vapor stream which includes condensible and non-condensible hydrocarbon products of pyrolysis. The particulate source of heat and solid particulate carbon containing residue of pyrolysis are transported to a cyclone burner and heated by partial combustion to a temperature suitable for feed to the cyclone reactor-separator. Rapid pyrolysis maximizes the yield of middle boiling hydrocarbons and olefins.

30 Claims, 3 Drawing Figures

PROCESS AND APPARATUS FOR RAPID PYROLYSIS OF CARBONACEOUS MATERIALS

BACKGROUND OF THE INVENTION

Due to increasing scarcity of fluid fossil fuels such as oil and natural gas, much attention is being directed towards converting solid carbonaceous materials such as coal, oil shale, and solid waste to liquid and gaseous hydrocarbons by pyrolyzing the solid carbonaceous material. Typically, pyrolysis occurs under non-oxidizing conditions in the presence of a particulate source of heat.

In the past, pyrolysis has been carried in tubular reactors. While effective, the yield of middle boiling hydrocarbons, i.e. $C_5$ hydrocarbons to hydrocarbons having an end point of about 950° F has been less than desired. Their loss has been attributed to protracted effective pyrolysis times which result in thermal cracking of such hydrocarbons. A need exists therefore for a more efficient pyrolysis process which maximizes the yield of the middle boiling hydrocarbons which are useful for the production of gasoline, diesel fuel, heating oil, and the like.

SUMMARY OF THE INVENTION

According to the present invention, there is provided a process for the pyrolysis of carbonaceous materials and the apparatus used therefore.

In the process of this invention, a stream of carbonaceous material is tangentially introduced at a high velocity along the path formed by the curved surface of a cyclone reaction separation zone, the cyclone reaction separation zone having a vapor outlet at one end and a solids outlet at the opposed base thereof. Simultaneously, there is introduced to the cyclone separation zone a high velocity, high temperature stream of a particulate solid source of heat contained in a carrier gas, which is non-deleteriously reactive with respect to the products of pyrolysis, at an angle inclined to the path of travel of the carbonaceous material. The introduced particulate solid source of heat penetrates the stream of carbonaceous material to initiate pyrolysis of carbonaceous material. The quantity of particulate solid source of heat introduced is sufficient to raise the carbonaceous material to the desired pyrolysis temperature within the contact time between the carbonaceous material and the solid particulate source of heat.

Pyrolysis yields a pyrolytic vapor comprised of condensible and normally non-condensible hydrocarbons and a particulate carbon containing solid residue.

There continuously occurs a separation between the gaseous mixture of the carrier gas and the pyrolytic vapor from the solids mixture of the particulate solid source of heat and carbon containing solid residue by action of centrifugal forces. This results in separate flow patterns for each and termination of the principle pyrolysis reactions.

The gaseous mixture consisting of the carrier gas and the pyrolytic vapors are withdrawn from the cyclone reaction separation zone and introduced to a quench zone where the condensible hydrocarbons are condensed by contact with a quench fluid, and fractionated into a product middle cut hydrocarbon and a heavy fraction used as the quench fluid.

The mixture of the particulate solid source of heat and the carbon containing solid residue of pyrolysis are withdrawn from the solids outlet of the cyclone reaction-separation zone and at least a portion to a combustion system for generation by partial oxidation, the particulate solid source of heat for return to the pyrolysis zone. There is preferably used a cyclone burner where the solids are introduced at an inclined angle to a tangential flow of a gaseous source of oxygen, typically air. Because combustion occurs by impinging the particulate solids mixture onto the flow of the gaseous source of oxygen, combustion is rapid maximizing carbon dioxide formation and thereby the amount of heat generated for each unit of carbon monoxide. This heats the solids to a temperature suitable for feed as the particulate heat source back to the cyclone reaction separation zone.

In the process of this invention, pyrolysis can occur at a temperature from about 600° F to the temperature where the inorganic portion of the particulate source of heat or the carbonaceous feed begin to soften leading to slagging or fusion, preferably from about 600° to about 2000° F. The contact times in the cyclone separation zone are preferably less than 3 seconds, preferably from 0.1 to 1 second and more preferably from 0.2 to 0.6 second, with short contact preferred to enhance formation of the middle boiling hydrocarbons, i.e. hydrocarbons in the range of $C_5$ hydrocarbons to hydrocarbons having an end point of 950° F and olefins. To this end, it is also preferred to conduct pyrolysis at a temperature from about 600° to about 1400° F, more preferably from 900° to 1400° F. Other product specifications may require operating at higher temperatures to promote gasification reactions.

To achieve pyrolysis the solid particulate source of heat is generally introduced at a temperature from about 100° to about 500° F higher than the pyrolysis temperature to be achieved. The solids weight ratio of the particulate source of heat to the carbonaceous feed will range from about 2 to about 20.

To achieve pyrolysis and proper separation, feed velocities will range from about 100 to about 250 feet per second. Equivalent velocities are employed in the cyclone burner.

Although pyrolysis is essentially terminated once solids-gas separation occurs in the cyclone reaction separation zone, to finally terminate pyrolysis, the gaseous effluent is passed to a quench zone where it is brought in contact with a quench fluid, preferably a portion of the hydrocarbon condensate. The quench fluid reduces gas temperature below the dew point of the condensible hydrocarbons and the mixture is fed to a recovery zone such as a fractional distillation column. The off-gases pass overhead and the middle cut hydrocarbon product withdrawn from the center of the fractionation zone. The heavy hydrocarbons are withdrawn from the base. A portion is recycled as reflux, another portion employed as a quench and the balance returned to he pyrolysis zone for pyrolysis to extinction.

Steam may be included as a portion of the carrier gas to generate hydrogen in situ by a water-gas shift reaction to saturate the hydrocarbons formed in the pyrolysis reaction to prevent their polymerization to higher molecular weight hydrocarbons.

The apparatus employed to carry out the process of this invention consists of a cyclone reaction separator having a tangential inlet for carbonaceous feed material and an inclined inlet for the feed of the particulate solid source of heat, a gas outlet at one end and a solids outlet at the opposed end. The gas outlet of the cyclone separator is connected to a venturi quench scrubber which, in turn, is connected to a product recovery and separation means.

The base of the cyclone reactor separator is connected to a particulate solids stripper connected to, in turn, a conduit system consisting of a standpipe, angle riser and a vertical riser for carrying a particulate solids to at least one cyclone burner. Cyclone burner has a tangential inlet for the introduction of an oxygen containing gas, air, and an inlet for the carbon containing solids to undergo combustion, the inlet being inclined to the path of travel of the oxygen containing gas. If desired, two or more cyclone burners may be used. The heated solid source of heat is collected in a sump for feed by a second conduit system at a high velocity to the cyclone reactor separator.

DRAWINGS

DESCRIPTION

Figures 1, 2, 3:
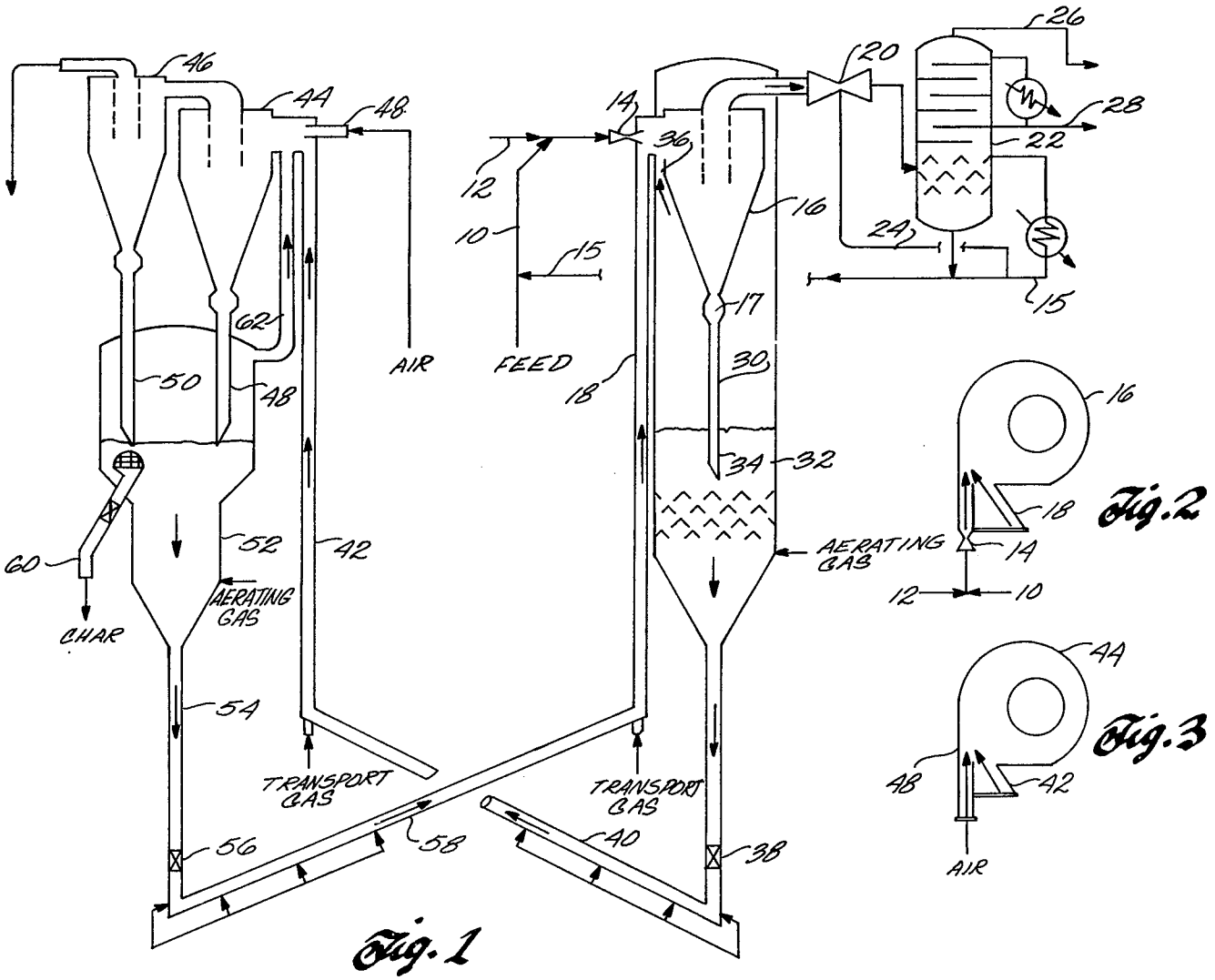
FIG. 1 illustrates the overall apparatus useful to carry out the process of this invention.
FIG. 2 illustrates the top view of the cyclone reactor separator.
FIG. 3 illustrates the top view of a cyclone burner.

According to the present invention, there is provided a process for the pyrolysis of liquid and solid carbonaceous materials which may be used to maximize the yield of middle distillate hydrocarbons by extremely short pyrolysis contact times and apparatus therefore.

The carbonaceous materials which may be pyrolyzed in accordance with the present invention include solids such as agglomerative coals, nonagglomerative coals, tar sands, shale, oil shale, the organic portion of solid wastes and the like and liquids such as shale oils, tar sand oils, heavy refinery hydrocarbons and the heavy hydrocarbons which result from the pyrolysis operations as well as mixtures thereof. For solids, it is desired to limit particle size to about 1000 microns and 250 microns for the instance of agglomerative coals.

With reference to FIGS. 1 and 2, the carbonaceous material enters feedline 10 along with, if necessary, a carrier gas 12 and, if desired steam, to a venturi mixer 14. If desired, the heavy hydrocarbons of pyrolysis may be combined with the feed and added by line 15. The carrier gas, if employed, is nondeleteriously reactive with respect to the products of pyrolysis. By the term "nondeleteriously reactive" as applied to the carrier gas or gas stream, there is meant a gas essentially free of free oxygen but which may contain constituents which react with the pyrolysis products to upgrade their value. To be avoided are constituents which by reaction degrade the pyrolysis products. It can serve as a diluent to minimize pyrolysis contact time and in the instance of solid carbonaceous materials as the transport gas. The carrier gas may, for instance, be the inert off-gas product of pyrolysis, steam which will react under suitable conditions with the char or coke formed from pyrolysis to yield by a water-gas shift reaction hydrogen which serves to react with and stabilize unsaturates in the products of pyrolysis or any desired inert gas or mixtures thereof.

With reference to FIG. 2, the carbonaceous feed and the carrier gas, if present, are injected as a stream into cyclone reactor separator 16 tangentially to the walls thereof. Venturi 14 serves to intimately mix the carbonaceous feed with the carrier gas to enhance dilution of the feed to promote short reaction pyrolysis times.

Simultaneously, there is introduced a particulate solid source of heat through line 18 at an angle inclined to the path of travel of the stream of carbonaceous material. The solid particulate source of heat is transported into the pyrolysis reactor by carrier gas which may be the same or different from the gas carrying the carbonaceous feed into the pyrolysis reactor, although it will be at a temperature approximately equal to the temperature of the particulate solid source of heat.

The hot particulate solids are supplied at a rate and at a temperature consonant with maintaining a temperature along the walls of the cyclone reactor separator 16 suitable for pyrolysis. Pyrolysis will initiate at about 600° F below the softening temperature of the inorganic constituents of the particulate source of heat or the carbonaceous feed which would lead to slagging or fusion, preferably from 600° to about 2000° F. More typically, however, pyrolysis is conducted at a temperature from about 600° to about 1400° F, more preferably 900° to about 1400° F to maximize the yield of middle boiling hydrocarbons and olefins. Higher temperatures may be employed with equal ease to facilitate, where desired, gasification reactions.

Depending upon pyrolysis temperature, normally from about 2 to about 20 pounds of particulate solid source of heat are fed per pound of carbonaceous material entering reactor 16. The solids employed may be solids provided external to the process such as sand or the solid product resulting from pyrolysis of the carbonaceous material such as char or coke or in the instance of municipal solid waste, the glass-like inorganic residue resulting from the decarbonization of the solid residue of pyrolysis. The particulate source of heat is generally at a temperature from about 100° to about 500° F or more above the desired pyrolysis temperature.

The amount of gas employed to transport the solid carbonaceous material and the particulate source of heat is sufficient to maintain transport of the materials and avoid plugging and normally in excess of that amount to dilute materials and minimize pyrolysis contact time. Normally, the solids content will range from about 0.1 to about 10% by volume based on the total volume of the stream.

The particulate solid source of heat penetrates and enters the stream of carbonaceous material. This penetration initiates the rate of heat transfer from the particulate solid source of heat to the carbonaceous material, instantaneously causing pyrolysis which is a combination of vaporization and cracking reactions. As the vaporization and cracking reactions occur, condensible and non-condensible hydrocarbons are generated from the carbonaceous material with an attendant production of a carbon containing solid residue such as coke or char. The carbon containing solid residue and the particulate source of heat being the heaviest materials present are retained and pass spirally along the walls of the cyclone reactor separator 16 and settle to reservoir 17 at the base thereof. The carrier gas as well as the pyrolytic vapors separate in spiral vortex flow towards the center of the cyclone reactor separator 16 and rapidly terminate the primary pyrolysis reactions due to the absence of solids. Effective pyrolysis contact time will be less than 3 seconds, preferably from about 0.1 to 1 second, more preferably from 0.2 to about 0.6 second.

"Pyrolysis contact time" or "contact time" as referenced to pyrolysis, as used herein, means the time from when the carbonaceous material first contacts the particulate source of heat until the vaporized products separate from the particulate source of heat. A convenient measure of contact time is the average residence time of the carrier gas in the cyclone reactor separator. The lower limit is that required to heat the carbonaceous material to the desired pyrolysis temperature. This is a function of particle size and concentration of solid particulate source of heat. For example, under average feed conditions, contact time to achieve about 1000° F is about 1.5 seconds for particles of about 250 microns in diameter and 0.5 seconds for particles of 75 microns in diameter.

The carrier gas along with the pyrolytic vapor exit reactor 16 and enter venturi mixer 20 where they are contacted with a quench fluid to reduce gas temperature at least below pyrolysis and cracking temperatures to prevent further cracking reactions from occurring. Preferably, the quench fluid reduces temperatures below the dew point of the condensible hydrocarbons. Typically a portion of the condensed heavier hydrocarbons formed from the pyrolysis reactor employed as a quench fluid and are fed to venturi by line 24. Immiscible quench oils may also be used and when used are separated from the products and recycled to venturi 20.

The quench effluent, normally a mixture of gas and liquids, are fed to fractionating tower 22. In fractionating tower 22 the carrier gas and lighter hydrocarbons are separated from the middle distillate hydrocarbons which are, in turn, separated from heavy hydrocarbons. Normally, the gaseous cut, containing about $C_4$ hydrocarbons and less, exit the top of fractionator 22 by line 26.

The cut of about $C_5$ to hydrocarbons having an end point of about 950° F which constitutes gasoline, diesel and heating fuel components are separated as middle distillate hydrocarbon products in line 28. A portion may be cooled and recycled as reflux.

The heavy hydrocarbon residue exits the base of fractionator 22 and is cooled. One portion is recycled as reflux, another as quench and the balance, if not recovered, as a product returned to cyclone reactor separator 16 to be pyrolyzed to extinction.

Because of short residence time and at pyrolysis temperatures below about 1400° F, the amount of $C_4$ hydrocarbons plus the carbon containing solid residue of pyrolysis will be a minimum while the $C_5$ to 950° F end point fraction will be maximized. The $C_4$ and lower hydrocarbons will tend to be rich in olefins if hydrogen is not added to or generated in cyclone reactor separator 16. The amount of $C_4$ or less hydrocarbons generated will increase with pyrolysis temperature and pyrolysis contact time.

The presence of hydrogen during pyrolysis whether internally generated or externally supplied is desired to enhance stabilization of the hydrocarbons formed, particularly the heavier hydrocarbon to prevent their polymerization to tars.

The particulate carbon containing solid residue of pyrolysis and the particulate solid source of heat exit reservoir 17 and pass by line 30 and collected in a fluidized stripper 32. A flow of a carrier gas which is also non-deleteriously reactive with respect to the products of pyrolysis enters the base of stripper 32 to maintain the solids in a mixed condition and in at least a semi-fluidized state. Flap 34 on leg 30 prevents backflow of the aeration gas into the cyclone. Rather, the aeration gas is bypassed around cyclone reactor separator 16 through conduit 36 for combination with the feed. The aeration gas serves to remove any of the hydrocarbon oils which result from pyrolysis from the surface of the particles and return them to the system for further pyrolysis.

The cooled particulate source of heat and carbon containing solid residue of pyrolysis are passed through slide valve 38 and transported along angle riser 40 and vertical riser 42 to a combustion zone, preferably cyclone burner 44, the cross section view of cyclone burner 44 which is depicted in FIG. 3. The cyclone burner may be operated in conjunction with an identical cyclone burner 46 or simply a cyclone separator for fines. If other combustion apparatus are used, a cyclone separator is employed to separate flue gases from the particulate source of heat.

Combustion cyclone 44 operates in a manner substantially identical to cyclone reactor separator 16. The transport gas used to introduce to carry the particles to cyclone burner 44 may be air or flue gas with the balance of the combustion air injected tangentially through line 48 of cyclone burner 44. As shown in FIG. 3, the solids penetrate the air stream at an inclined angle and rapidly undergo oxidative combustion. The heavier particles rapidly pass through the air stream, such that effective combustion residence time is short, ranging from about 0.1 to about 0.6 second. As a consequence, even despite the fact that excess air is supplied, the effective residence time for combustion is short. As a result the amount of carbon dioxide generated will be maximized, as the faster carbon dioxide reaction rate is favored as compared to the slower carbon monoxide reaction rate. As a consequence, the amount of heat generated per unit of carbon consumed is maximized. In general, partial combustion will yield a flue gas having a $CO_2$ to CO ratio of about 2 to 1.

The gases and fine solids which elude recovery from cyclone 44 enter cyclone 46 where additional air may be added again using a cyclone as depicted in FIG. 3 for short contact time combustion. Alternatively, a simple cyclone separator may be employed. The high temperature particulate source of heat collected in cyclones 44 and 46 pass by standpipes 48 and 50 to aerated surge hopper 52. Surge hopper 52 is maintained at a temperature consonant with the operating temperature of the pyrolysis reactor 16 and generally from about 300° to about 500° F above the pyrolysis temperature.

As required, the particulate source of heat is passed through standpipe 54, slide valve 56, angle riser 58 to vertical riser 18 for feed to cyclone reactor separator 16. Excess particles are withdrawn from surge hopper 52 through screen siphon tube 60 as product char.

The aeration gas employed in surge hopper 52 may be steam which becomes super heated by contact with the contained particulate source of heat and forms hydrogen by a water gas shift reaction. This gas passes through pass line 62 for feed to cyclone 44 and cyclone 46 as part of the carrier gases. The use of the gas, however, is contingent on complete consumption of oxygen in cyclones 44 and 46 as the gas entering pyrolysis cyclone reactor 16 must be essentially free of oxygen.

The transfer gas in vertical riser 18 serves to accelerate the particulate source of heat to the velocity required for feed to cyclone reactor separator 16.

What is claimed is:

1. In a process for the pyrolysis of carbonaceous materials wherein the carbonaceous material is primarily pyrolyzed by heat transferred thereto from a high temperature, particulate solid source of heat to yield as products of pyrolysis, a pyrolytic vapor including condensible and noncondensible hydrocarbons and a particulate carbon containing solid residue, the improved method of achieving rapid pyrolysis which comprises:

(a) tangentially introducing to and passing along the path formed by the curved inner surface of a cyclone reaction separation zone having a vapor outlet at one end and a solids outlet at the base thereof, a high velocity stream of carbonaceous material, while;

(b) introducing into the high velocity stream of carbonaceous material at about the entrance of said cyclone reaction separation zone a high velocity, high temperature stream of the particulate solid source of heat contained in a carrier gas which is nondeleteriously reactive with respect to the products of pyrolysis at an angle inclined to the path of travel of said carbonaceous material to penetrate and initiate pyrolysis of said carbonaceous material, the introduced quantity of particulate source of heat being sufficient to raise the carbonaceous material to a pyrolysis temperature of at least about 600° F while simultaneously;

(c) separating a gaseous mixture of the carrier gas and pyrolytic vapor from a solids mixture including the particulate solid source of heat and the carbon containing solids residue by the formation of a separate flow pattern of each mixture, the formed flow patterns being created by centrifugal forces induced at least in part by the high introduction velocities of each feed stream.

2. The process of claim 1 in which the introduction velocity of each stream is from about 100 to about 250 feet per second.

3. The process of claim 1 in which the pyrolysis temperature is from about 600° to about 2000° F.

4. The process of claim 1 in which the pyrolysis temperature is from about 600° to about 1400° F.

5. The process of claim 1 in which the pyrolysis temperature is from about 900° to about 1400° F.

6. The process of claim 1 in which pyrolysis is carried out at a contact time of from about 0.1 to about 3 seconds.

7. The process of claim 1 in which pyrolysis is carried out at a contact time of from about 0.1 to about 1 second.

8. The process of claim 1 in which the weight ratio of particulate solid source of heat to carbonaceous material is from about 2 to about 20.

9. The process of claim 1 in which the particulate source of heat is introduced at a temperature from about 100° to about 500° F above the pyrolysis temperature.

10. The process of claim 1 in combination with the steps of:

(a) passing solids mixture to a cyclone combustion zone in which a stream of a gaseous source of oxygen is tangentially introduced to the cyclone combustion zone and the solids mixture at an angle inclined thereto to heat the solids to a temperature for introduction to the cyclone reaction separation zone; and (b) separating the heated solid mixture from the cyclone combustion zone at the high velocity, high temperature particulate source of heat to the cyclone reactor separator.

11. A process for the pyrolysis of carbonaceous materials which comprises:

(a) tangentially introducing to and passing along the path formed by the curved inner surface of a cyclone reaction separation zone having a vapor outlet at one end and a solids outlet at the opposed base thereof, a high velocity stream of carbonaceous material while:

(i) introducing into the high velocity stream of carbonaceous material at about the entrance of said cyclone reaction separation zone a high velocity, high temperature stream of a particulate solid source of heat contained in a carrier gas which is non-deleteriously reactive with respect to products of pyrolysis at an angle inclined to the path of travel of said stream of carbonaceous material to penetrate and initiate pryolysis of said carbonaceous material, the quantity of particulate source of heat introduced being sufficient to raise the carbonaceous material to a pyrolysis temperature of at least about 600° F, to yield a pyrolytic vapor comprised of condensible and normally noncondensible hydrocarbons and a particulate carbon containing solid residue while simultaneously;

(ii) separating a gaseous mixture of the carrier gas and pyrolytic vapor from a particulate solids mixture of the particulate solid source of heat and the carbon containing solid residue by the formation of a separate flow pattern of each mixture, the flow patterns being created by centrifugal forces induced at least in part by the high introduction velocities of each feed stream;

(b) withdrawing the gaseous mixture from the vapor outlet of the cyclone separation reaction zone receiving the condensible hydrocarbons, and separating from the condensed hydrocarbons a light hydrocarbon fraction;

(c) withdrawing from the solids outlet of the cyclone reaction separation zone the particulate solids mixture and transferring said particulate solid mixture to a first solids collection zone wherein the particles are maintained in a dense fluidized state;

(d) withdrawing from the first particles collection zone at least a portion of the particulate solids mixture and transporting the particulate solids mixture to a first inlet of a cyclone combustion zone, said first inlet being inclined to a second inlet through which a stream of a source of oxygen is tangentially introduced and rapidly combusting at least a portion of the carbon in the particulate solids mixture by impinging the particulate solids mixture into the flow of the source of oxygen entering zone to form the high temperature particulate solid source of heat and a flue gas; and (e) removing the high temperature particulate solid source of heat from the cyclone combustion zone and transporting the high temperature particulate solid source of heat to said cyclone reaction separation zone.

12. A process as claimed in claim 11 in which the condensible hydrocarbons are recovered by:

(a) passing the gaseous mixture to a venturi quench zone where by introduction of a quench fluid, the condensible hydrocarbons are condensed to yield a gaseous residue;

(b) passing the quench fluid, condensed hydrocarbons and gaseous residue to a fractional separation zone;

(c) separating in the fractional separation zone the gaseous residue from the condensed hydrocarbons and the condensed hydrocarbons into a middle distillate hydrocarbon fraction and a heavy hydrocarbon fraction; and (d) recovering the light hydrocarbon fraction as product and passing at least a portion of the heavy hydrocarbon fraction to the venturi quench zone as the quench fluid.

13. The process of claim 11 in which the introduction velocity of each stream is from about 100 to about 250 feet per second.

14. The process of claim 11 in which pyrolysis temperature is from about 600° to about 2000° F.

15. The process of claim 11 in which the pyrolysis temeprature is from about 600° to about 1400° F.

16. The process of claim 11 in which the pyrolysis temperature is from about 900° to about 1400° F.

17. The process of claim 11 in which pyrolysis is carried out at a contact time of from about 0.1 to about 3 seconds.

18. The process of claim 11 in which pyrolysis is carried out at a contact time of about 0.1 to about 1 second.

19. The process of claim 11 in which the weight ratio of particulate solid source of heat to carbonaceous material is from about 2 to about 20.

20. The process of claim 11 in which the particulate source of heat is introduced at a temperature from about 100° to about 500° F above the pyrolysis temperature.

21. A process for the pyrolysis of carbonaceous materials which comprises:

(a) tangentially introducing to and passing along the path formed by the curved inner surface of a cyclone reaction separation zone having a vapor outlet at one end and a solids outlet at the opposed base thereof, a high velocity stream of carbonaceous material while:

(i) introducing into the high velocity stream of carbonaceous material at about the entrance of said cyclone reaction separation zone a high velocity, high temperature stream of a particulate solid source of heat contained in a carrier gas which is non-deleteriously reactive with respect to products of pyrolysis at an angle inclined to the path of travel of said stream carbonaceous material to penetrate and initiate pyrolysis of said carbonaceous material, the quantity of particulate heat source of being sufficient to raise the carbonaceous material to a pyrolysis temperature of from about 600° to about 1400° F within about 0.1 to about 3 seconds to yield a pyrolytic vapor comprised of condensible and normally noncondensible hydrocarbons and a particulate carbon containing solid residue, while simultaneously;

(ii) separating a gaseous mixture of the carrier gas and pyrolytic vapor from a particulate solids mixture of the particulate solid source of heat and the carbon containing solids residue by the formation of a separate flow pattern of each mixture, the flow patterns created by centrifugal forces induced at least in part by the high introduction velocities of each feed stream;

(b) withdrawing the gaseous mixture from the vapor outlet of the cyclone separation reaction zone and introducing the gaseous mixture to a quench zone where the hydrocarbons are condensed by contact with a quench fluid to have a gaseous residue;

(c) passing the effluent from the quench zone to a fractional separation zone wherein the gaseous residue is separated from the condensed hydrocarbons and the condensed hydrocarbons fractionated into a light hydrocarbon product and heavy hydrocarbons at least a portion of which is recovered as quench fluid;

(d) withdrawing from the solids outlet of the cyclone reaction separation zone the particulate solids mixture and transferring the particulate solids mixture to a first solids collection zone wherein the particles are maintained in a dense fluidized state;

(e) withdrawing from the first particles collection zone at least a portion of the particulate solids mixture and passing the particulate solids mixture through a first fluidized conduit to a first inlet of a cyclone combustion zone, said first inlet being inclined to a second inlet through a stream of a gaseous source of oxygen tangentially introduced;

(f) rapidly combusting at least a portion of the solids mixture and particulate carbon in the cyclone burner by impinging the particulate solids mixture into the stream of the gaseous source of oxygen entering said cyclone combustion zone to form the high temperature particulate source of heat and a flue gas;

(g) removing the high temperature particulate solid source of heat from the cyclone combustion zone to a second particles collection zone; and (h) withdrawing from the second particles collection zone a portion of the high temperature particulate solid source of heat to a second vertically oriented fluidized conduit and transporting said high temperature particulate solid source of heat at a high velocity to said cyclone reaction separation zone.

22. The process of claim 21 in which the introduction velocity of each stream is from about 100 to about 250 feet per second.

23. The process of claim 21 in which the pyrolysis temperature is from about 900 to about 1400° F.

24. The process of claim 21 in which the contact time is from about 0.1 to about 1 second.

25. The process of claim 21 in which the weight ratio of particulate solid source of heat to carbonaceous material is from about 2 to about 20.

26. The process of claim 21 in which the particulate source of heat is introduced at a temperature from about 100° to about 500° F above the pyrolysis temperature.

27. Apparatus for pyrolysis of carbonaceous material in the presence of a particulate source of heat which comprises:

(a) a high temperature cyclone separator reactor having a tangential feed inlet for the carbonaceous material and a second feed inlet communicating with and adjacent to the first feed inlet at an angle thereto for feeding the particulate source of heat at an angle inclined to the tangential feed of the carbonaceous material for combination with and initiation of pyrolysis of the carbonaceous material, the angle being sufficient to cause the particulate source of heat to penetrate the feed of carbonaceous material, a vapor exhaust at one end thereof for removal of vaporized products of pyrolysis and a solids outlet at the opposed end thereof for removal of the particulate solid source of heat and carbon containing solid product of pyrolysis;

(b) quench means coupled in open receiving relation to said vapor exhaust outlet coupled and including means for introduction of a hydrocarbon quench fluid for condensing at least a portion of the high temperature vapors received from the vapor exhaust outlet;

(c) means connected to the quench means for fractional separation of condensate from the quench means;

(d) means for receiving the particulate solid source of heat and carbon containing solid products of pyrolysis, said means including means to aerate the collected particles;

(e) combustion means for combusting carbon contained in the particulate solid source of heat and the carbon containing solid residue of pyrolysis;

(f) means to transport the particulate solid source of heat and carbon containing solid product of pyrolysis to said combustion means;

(g) receiving means to receive the particulate solid source of heat from said combustion means; and (h) means to transport particulate solid source of heat from said receiving means to the second feed inlet of said cyclone separator reactor.

28. Apparatus as claimed in claim 27 in which means for fractional separation of the condensate from the quench means includes means to cycle a portion of a fractionally separated condensate as quench fluid to said quench means.

29. Apparatus for pyrolysis of carbonaceous material in the presence of a particulate source of heat which comprises:

(a) a high temperature cyclone separator-reactor having a tangential feed inlet for the carbonaceous material and a second feed inlet communicating with and adjacent to the first feed inlet at an angle thereto for feeding the particulate source of heat at an angle inclined to the tangential feed of the carbonaceous material for combination with and initiation of pyrolysis of the carbonaceous material, the angle being sufficient to cause the particulate source of heat to penetrate the feed of carbonaceous material, a vapor exhaust at one end thereof for removal of vaporized products of pyrolysis and a solids outlet at the opposed end thereof for removal of the particulate solid source of heat and carbon containing solid product of pyrolysis;

(b) quench means coupled in open receiving relation to said vapor exhaust outlet coupled and including means for introduction of a hydrocarbon quench fluid for condensing at least a portion of the high temperature vapors received from the vapor exhaust outlet;

(c) means connected to the quench means for fractional separation of condensate from the quench means;

(d) means for receiving the particulate solid source of heat and carbon containing solid products of pyrolysis, said means including means to aerate the collected particles;

(e) at least one cyclone burner having a tangential inlet for a gaseous source of oxygen, a second inlet inclined at an angle to the tangential inlet for the gaseous source of oxygen for receiving transported particulate solid source of heat and carbon containing solid product of pyrolysis, a flue gas outlet at one end thereof and an outlet for the formed particulate solid source of heat at the base thereof;

(f) first conduit means to transport the particulate solid source of heat and carbon containing solid product of pyrolysis to the second inlet of the cyclone burner;

(g) receiving means to receive the particulate solid source of heat from said cyclone burner; and (h) second conduit means to transport particulate solid source of heat from said receiving means to the second feed inlet of said cyclone separator reactor.

30. Apparatus as claimed in claim 29 in which means for fractional separation of the condensate from the quench means includes means to cycle a portion of a fractionally separated condensate as quench fluid to said quench means.

* * * * *

UNITED STATES PATENT AND TRADEMARK OFFICE

CERTIFICATE OF CORRECTION

PATENT NO. : 4,101,412

DATED : July 18, 1978

INVENTOR(S) : Charles K. Choi

It is certified that error appears in the above-identified patent and that said Letters Patent are hereby corrected as shown below:

Cover page of Patent, item [73] Assignee:, delete "Petroleum" and insert -- Research --.

Column 2, line 56, delete "he" and insert -- the --.

Column 9, line 11, delete "temeprature" and insert -- temperature --.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*